US009651276B2

(12) United States Patent
Ramirez et al.

(10) Patent No.: US 9,651,276 B2
(45) Date of Patent: May 16, 2017

(54) HEATER FOR SOLVENTS AND FLAMMABLE FLUIDS

(71) Applicant: Heateflex Corporation, Arcadia, CA (US)

(72) Inventors: Jorge Ramirez, Glendale, CA (US); Hector Joel Castaneda, Cypress, CA (US)

(73) Assignee: Heateflex Corporation, Arcardia, CA (US)

( * ) Notice: Subject to any disclaimer, the term of this patent is extended or adjusted under 35 U.S.C. 154(b) by 434 days.

(21) Appl. No.: 14/473,148

(22) Filed: Aug. 29, 2014

(65) Prior Publication Data

US 2016/0061489 A1 Mar. 3, 2016

(51) Int. Cl.

| | |
|---|---|
| ***F24H 1/10*** | (2006.01) |
| ***F24H 1/00*** | (2006.01) |
| ***H05B 3/04*** | (2006.01) |
| ***H05B 3/44*** | (2006.01) |

(52) U.S. Cl.

CPC ..... *F24H 1/0018* (2013.01); *H05B 3/04* (2013.01); *H05B 3/44* (2013.01); *H05B 2203/021* (2013.01)

(58) Field of Classification Search

None

See application file for complete search history.

(56) References Cited

U.S. PATENT DOCUMENTS

| | | | | | |
|---|---|---|---|---|---|
| 491,320 | A * | 2/1893 | Mitchell | F24H 1/102 | 392/458 |
| 1,008,622 | A * | 11/1911 | Thomson | H05B 6/108 | 219/552 |
| 1,027,831 | A * | 5/1912 | Fox | F24H 9/2028 | 165/156 |
| 1,110,919 | A * | 9/1914 | Gamble | F24H 1/102 | 392/481 |
| 1,120,830 | A * | 12/1914 | Mann | F24H 1/162 | 123/549 |
| 1,162,537 | A * | 11/1915 | Yager | F24H 1/162 | 122/27 |
| 1,200,766 | A * | 10/1916 | Searles, Jr. | F24H 1/103 | 392/473 |
| 1,369,900 | A * | 3/1921 | Macy | F24H 1/121 | 338/218 |
| 1,544,159 | A * | 6/1925 | Jento | F24H 1/162 | 392/481 |
| 1,615,166 | A * | 1/1927 | Cowles | F24H 1/162 | 392/396 |

(Continued)

*Primary Examiner* — Thor Campbell

(74) *Attorney, Agent, or Firm* — Kelly & Kelley, LLP

(57) ABSTRACT

A heater for solvents and flammable fluids having a heater core, an hermetically sealed electrical chamber, and a housing cap. The heater core includes a process fluid tube, a heating element, and a thermal well, all enclosed within a cast aluminum billet. The heating element, the process fluid tube, and the thermal well are all thermally associated with one another. The electrical chamber is embedded in a first end of the cast aluminum billet. Electrodes from the heating element extend into the electrical chamber and are connected to electrical wires. The electrical chamber is filled with a non-conducting epoxy that covers and encloses the electrical connections. The housing cap is sealingly disposed on the first end of the cast aluminum billet covering the electrical chamber.

34 Claims, 9 Drawing Sheets

(56) References Cited

U.S. PATENT DOCUMENTS 1,671,677 A * 5/1928 Keeton ..... F24H 1/142 392/489
1,716,996 A * 6/1929 Adam ..... F24H 1/162 392/481
1,817,214 A * 8/1931 Stuckwisch ..... F24H 1/162 392/481
1,926,958 A * 9/1933 Peterson ..... F22B 1/282 392/391
1,949,658 A * 3/1934 Remseth ..... F24H 3/0423 15/405
2,024,783 A * 12/1935 Smith ..... F24H 1/162 392/481
2,048,104 A * 7/1936 Clinefelter ..... B29C 35/04 165/104.19
2,247,816 A * 7/1941 McIlrath ..... F24H 1/162 392/481
2,576,558 A * 11/1951 Bede ..... H05B 3/00 165/11.1
2,673,919 A * 3/1954 Arvins ..... F24H 1/162 392/481
2,866,885 A * 12/1958 McIlrath ..... F24H 1/162 219/509
3,624,356 A * 11/1971 Havill ..... F24H 7/002 126/400
4,286,140 A * 8/1981 Dewulf ..... F24H 9/2014 165/156
4,358,667 A * 11/1982 Johnson ..... H05B 3/82 219/508
4,465,922 A * 8/1984 Kolibas ..... F24H 1/121 165/156
4,480,172 A * 10/1984 Ciciliot ..... F22B 1/288 165/140
4,512,324 A * 4/1985 Neary ..... F02M 31/125 123/549
4,825,047 A * 4/1989 Miles ..... A47C 21/048 219/217
4,975,559 A * 12/1990 Frisch ..... A47J 31/0573 392/449
6,536,450 B1 3/2003 Dolechek
6,736,150 B2 5/2004 Dolechek
6,804,965 B2 10/2004 Abras
7,286,752 B2 * 10/2007 Gourand ..... A47J 31/542 392/465
7,526,922 B2 5/2009 Abras
8,180,207 B2 * 5/2012 Shirai ..... E03D 9/08 392/465
8,515,268 B2 * 8/2013 Anliker ..... A47J 31/54 392/448
8,855,475 B2 * 10/2014 King ..... F24H 1/121 392/441

* cited by examiner

HEATER FOR SOLVENTS AND FLAMMABLE FLUIDS

BACKGROUND OF THE INVENTION

The present invention relates to a fluid heater for use with heating solvents and flammable fluids. More particularly, the present invention relates to such a fluid heater having an embedded and hermetically sealed electrical junction box.

In the semiconductor chip fabrication process, it is well known that there is a need for cleaning processes to remove unwanted residues from the surface of a substrate (i.e. wafer). These cleaning processes are performed after fabrication operations such as plasma etching or chemical mechanical polishing (CMP). Some of these cleaning processes include the steps of dipping a semiconductor substrate into a chemical solution, rinsing the semiconductor substrate with deionized water, and then drying the semiconductor substrate. One way the semiconductor industry is using to accelerate the drying time is by rotating the wafer and displacing the deionized water with heated isopropyl alcohol which then evaporates more rapidly than the deionized water.

There also exist other processes, where it is advantageous to apply heated solvents, or other flammable fluids, to the wafer surfaces. It has been found that heating these solvents and closely controlling their temperature can improve yields, increase throughput and better control the desired wafer processing.

Heating solvents and flammable fluids present an increased risk of fire or explosion. Existing fluid heaters have designs that do not effectively reduce this risk. Such existing fluid heaters place the process fluid tube in direct contact with the heat source, where heat is transferred via conduction. The fluid tube isolates the fluid from direct contact with the heat source, but the electrical components of the fluid heater are left exposed to potential fumes in the environment or exposure to spills caused by a leak in the tubing or from a loose fitting.

Prior art heaters are generally not acceptable due to the risk of ignition by a malfunctioning electrical circuit and because most heaters are not designed in a manner that prevents solvent fumes or spills from having direct contact with the heating element or from entering the heater's electrical components. The separation of the fumes from the electrical components is critical for safety because fires can be started when these fumes are in direct contact with electrical components or areas in which a spark or electrical arc can occur.

Accordingly there is a need for an improved solvent heater that is safe, reliable and accurate—having a reduced risk of fire or explosion. The present invention fulfills these needs and provides other related advantages.

SUMMARY OF THE INVENTION

The present invention is directed to a heater for solvents and flammable fluids. The heater includes a heater core having a process fluid tube, a heating element, and a thermal well, all enclosed within a billet—preferably a cast aluminum billet. The heating element is thermally associated with both the process fluid tube and the thermal well. The process fluid tube and thermal well may also be thermally associated with each other. In this instance, thermally associated means that heat may be transferred between the components.

The heater also includes an electrical chamber embedded in a first end of the billet. Electrodes from the heating element extend into the electrical chamber and are connected to electrical wires from an electrical conduit. The electrical chamber is filled with a non-conducting epoxy, which surrounds the electrical connections. A housing cap is disposed on the first end of the billet, wherein the electrical conduit passes through the housing cap.

The first end of the billet has an O-ring groove its perimeter and an O-ring gasket is disposed in the O-ring groove. The O-ring gasket and O-ring groove form a hermetic seal between the housing cap and the first end of the billet. A fluid inlet and a fluid outlet fluidly connected to the process fluid tube protrude from a second end of the billet. A thermal insulation layer is provided that surrounds the billet. A housing surrounds the billet and thermal insulation layer, which housing forms a contiguous body with the housing cap.

Heat sensors are operatively connected to the thermal well. The process fluid tube preferably comprises a coiled stack that surrounds the heating element substantially along its entire length. The heating element preferably comprises a U-shaped heating element. In a particularly preferred embodiment, the heating element comprises at least two or three U-shaped heating elements arranged in a nested configuration. In this nested configuration, two of the U-shaped heating elements are oriented orthogonally to one another. Where three U-shaped heating elements are used two of the U-shaped heating elements are oriented parallel to one another and the third U-shaped heating element is oriented orthogonally to the other two. Where there exist a plurality of heating elements, there also exists an equal number of thermal wells.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
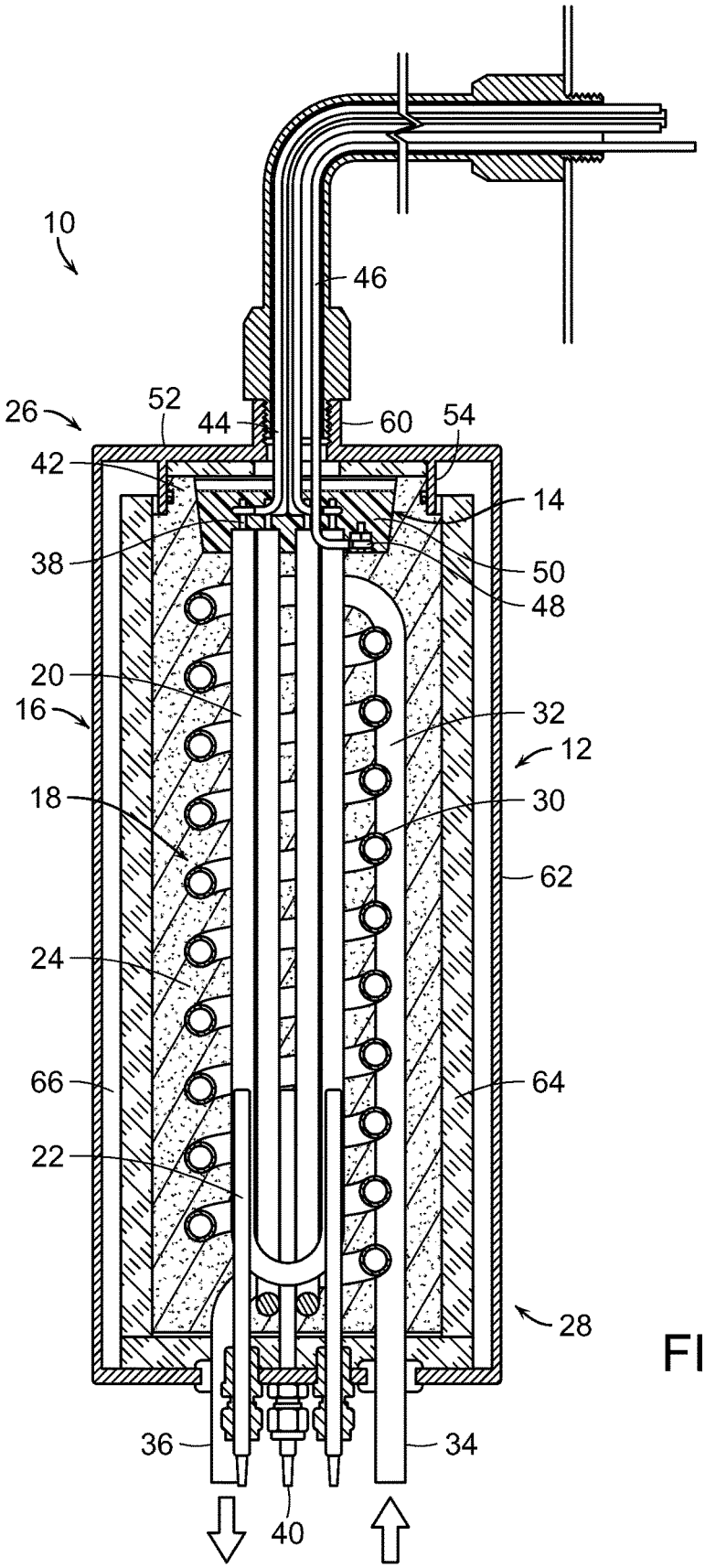
FIG. 1 is cross-sectional plan view of a fluid heater embodying the present invention.
Figure 2:
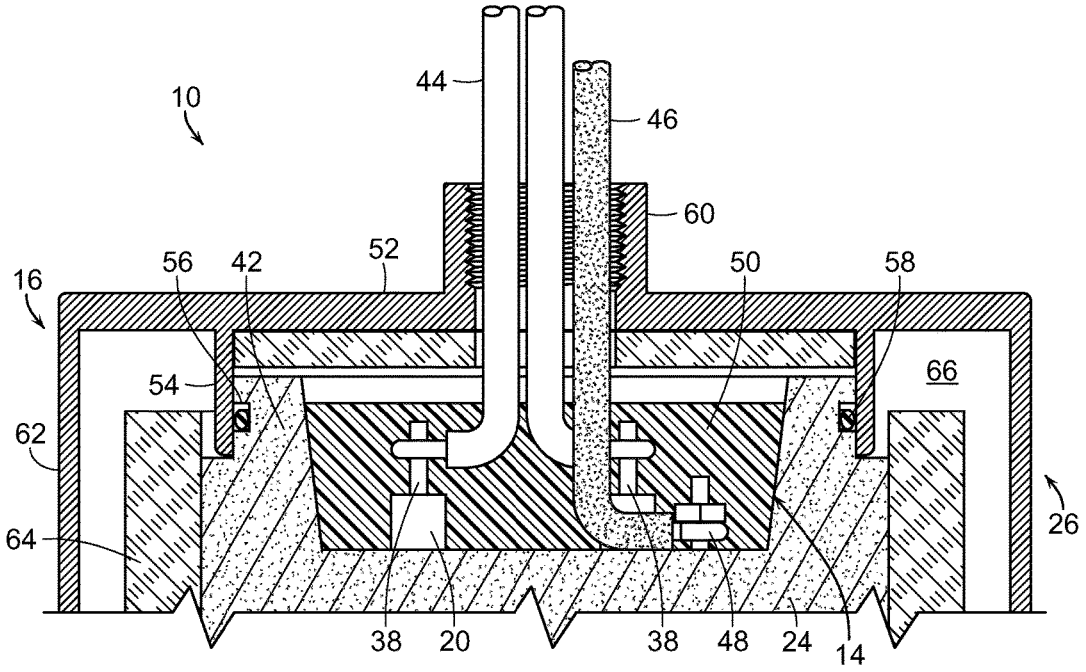
FIG. 2 is a close-up, cross-sectional plan view of the electrical junction box for the fluid heater of the present invention.
Figure 3:
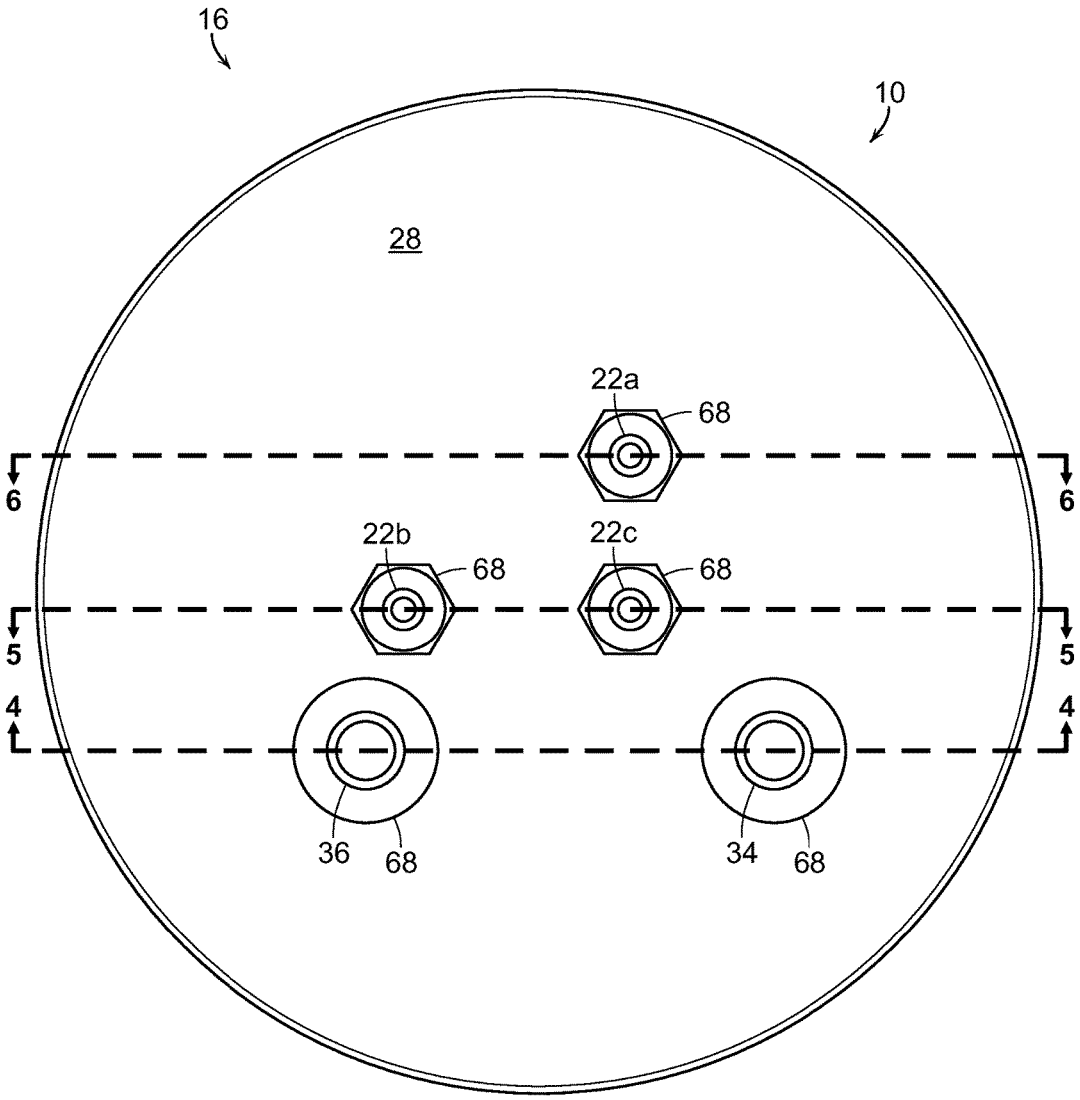
FIG. 3 is a bottom view of the fluid heater embodying the present invention.
Figure 4:
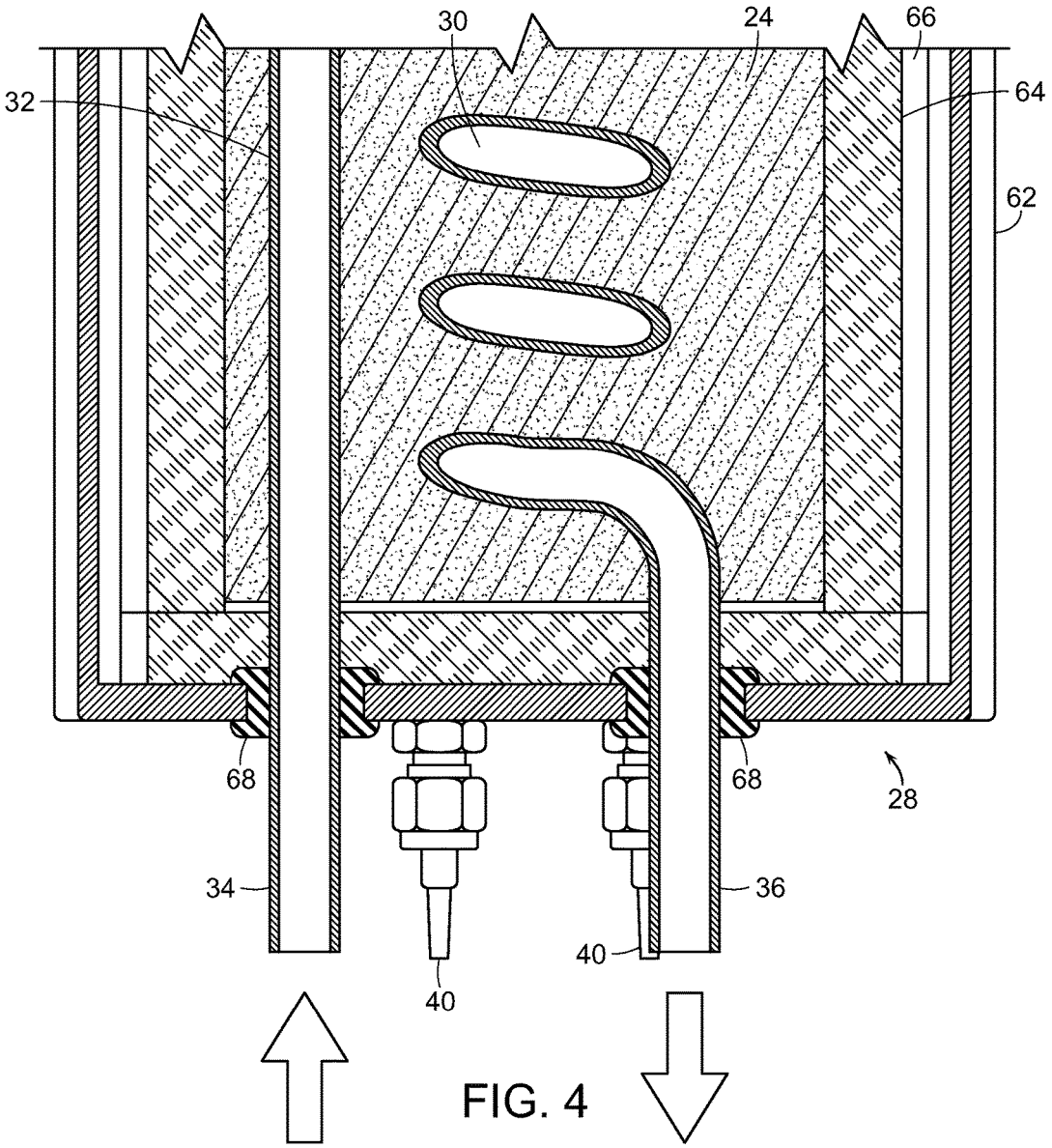
FIG. 4 is a cross-sectional view taken along line 4-4 of FIG. 3.
Figure 5:
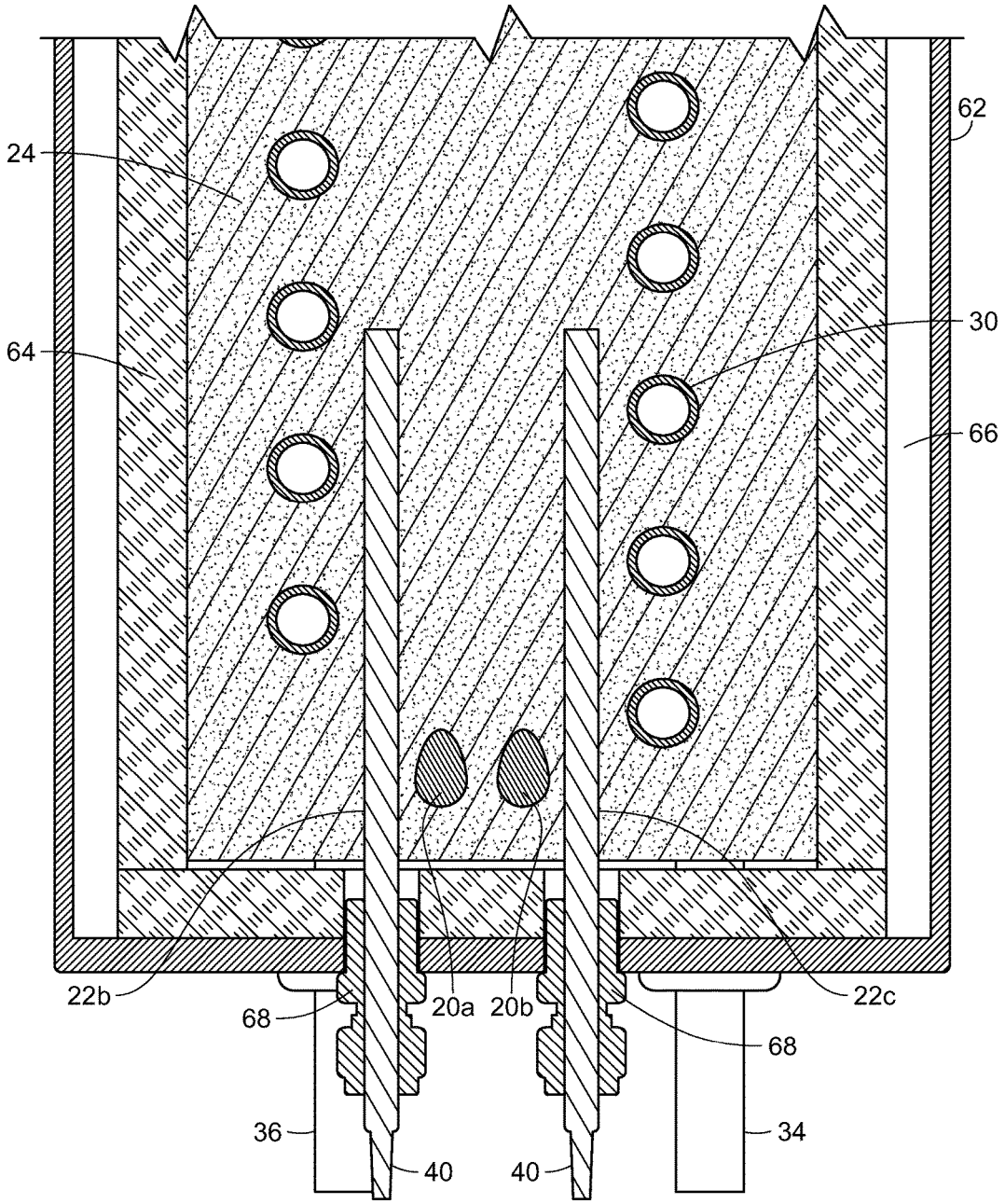
FIG. 5 is a cross-sectional view taken along line 5-5 of FIG. 3.
Figure 6:
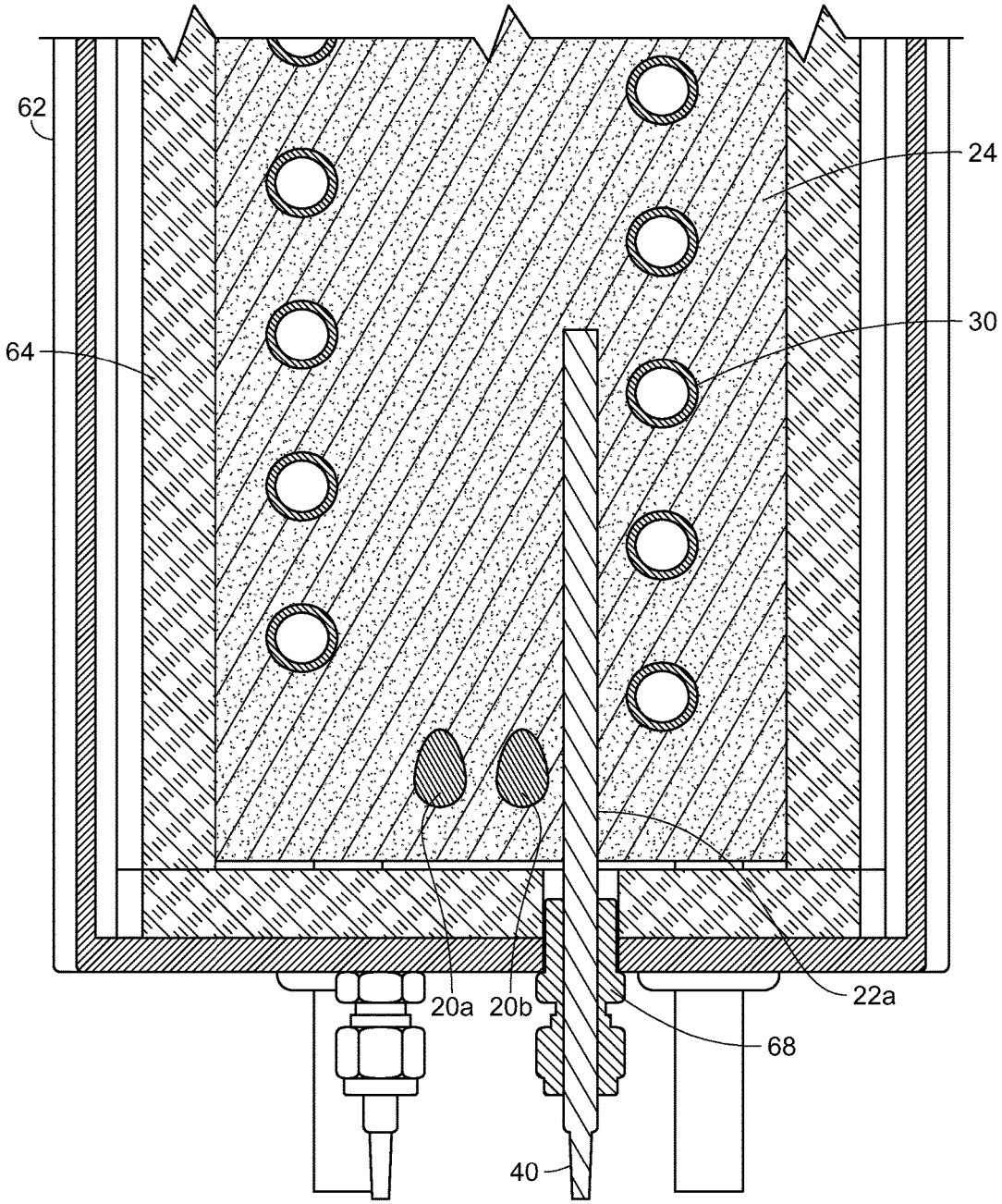
FIG. 6 is a cross-sectional view taken along line 6-6 of FIG. 3.
Figure 7:
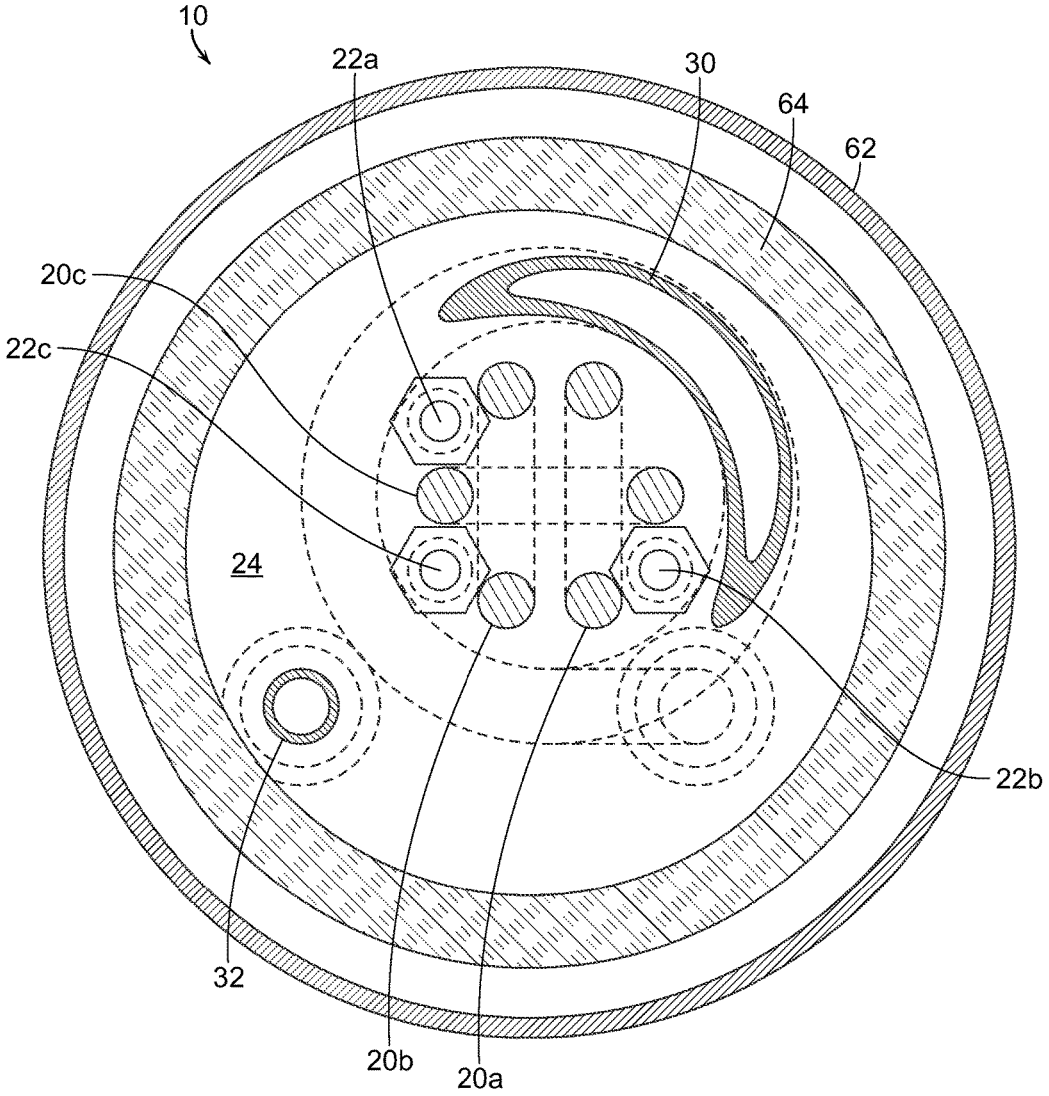
FIG. 7 is a cross-sectional view taken along line 7-7 of FIG. 4.

In the following detailed description, the fluid heater of the present invention is generally referred to by reference numeral 10 in FIGS. 1-7. The individual components and the overall structural relationship of the components of the fluid heater 10 are most clearly shown in FIG. 1.

The fluid heater 10 generally comprises a heater core 12, an electrical chamber 14, and a housing 16. The heater core 12 comprises the heart of the fluid heater 10 and includes a process fluid tube 18, a heating element 20, and a thermal well 22. A billet 24—preferably cast aluminum or similar material—encloses the tube 18, element 20, and well 22, such that each component is substantially wholly enclosed by the billet, except as explained below.

The electrical chamber 14 is a recess or cavity disposed in a first end 26 of the billet 24. When oriented in a preferred configuration, the first end 26 is generally at the top of the fluid heater 10, although the fluid heater 10 may be turned or rotated in any orientation. The second end 28 of the billet 24 is opposite the first end 26 and preferably the bottom of the fluid heater 10.

Figure 9:
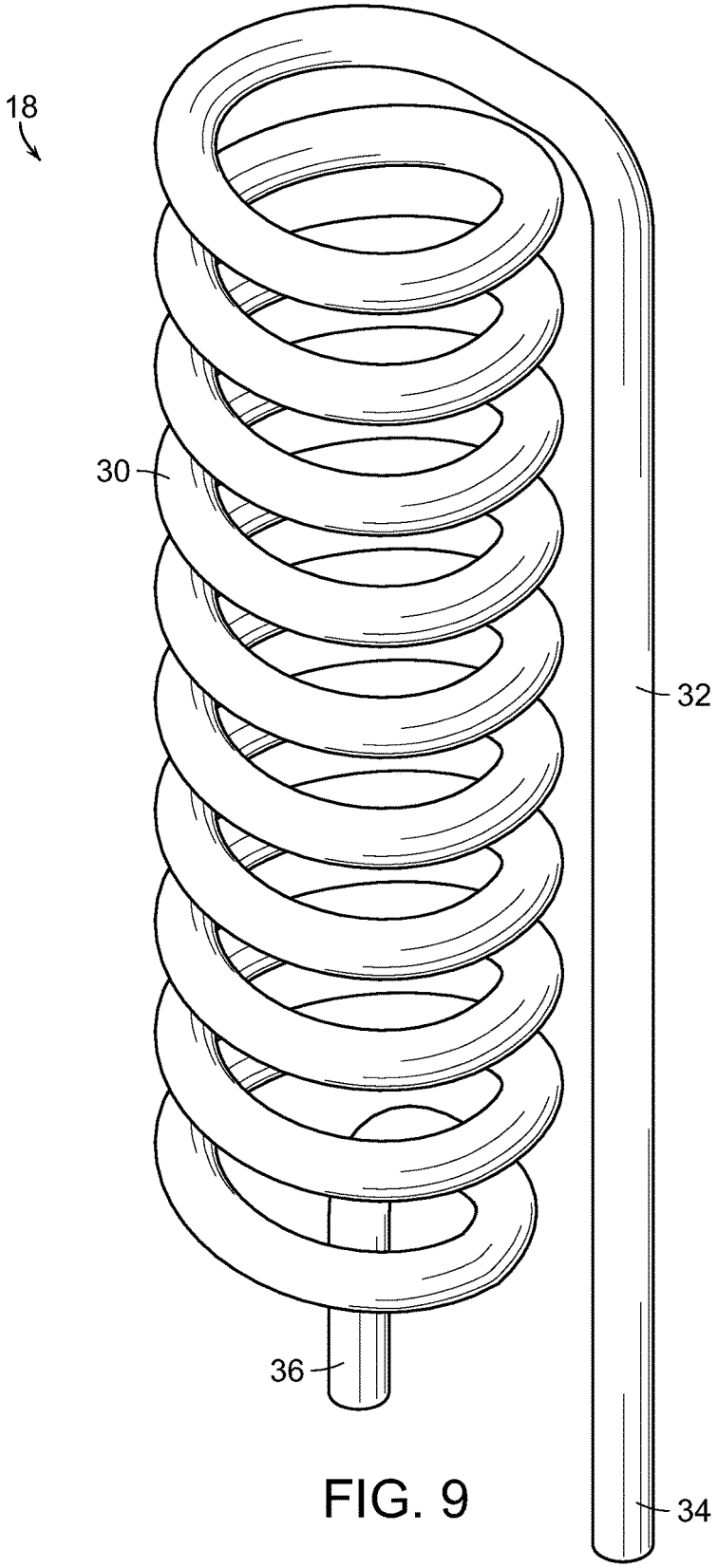
FIG. 9 is a perspective view of the fluid pipe from the fluid heater of the present invention.

As illustrated in FIG. 9, the process fluid tube 18 is preferably made from stainless steel and configured in a stacked coil 30 with a stack tube 32 extending substantially along the entire length of the stacked coil 30. The process fluid tube has an inlet 34 and an outlet 36 both preferably disposed at the second end 28 of the billet 24. Ideally, the stacked coil 30 and stack tube 32 extend from the second end 28 of the billet 24 to the second end 26 of the billet 24 immediately adjacent to the electrical chamber 14, while still being wholly enclosed by the cast aluminum. The inlet 34 and outlet 36 are the only parts of the tube 18 that are outside of the cast aluminum, and that being from the second end 28.

Figure 8:
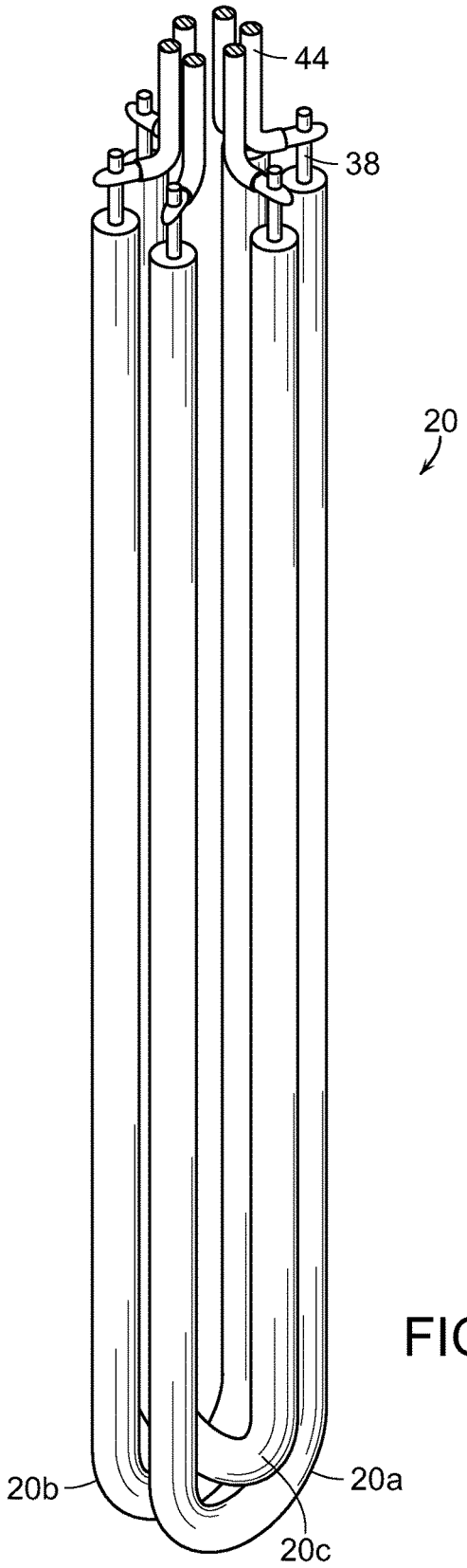
FIG. 8 is a perspective view of the heating elements from the fluid heater of the present invention.

As illustrated in FIG. 8, the heating element 20 preferably comprises three U-shaped elements 20*a*, 20*b*, 20*c*. In alternate embodiments, the heating element 20 may comprise alternate shapes or be provided in varying numbers. The heating element 20 preferably has a shape and size that permits the heating element to fit within the stacked coil 30 such that heat may be conducted from the heating element 20 to the process tube 18. One important design aspect of the heating element 20 is that electrodes 38 on the heating element 20 be proximate to one another such that they may be disposed on the same end of the billet 24. While the heating element 20 is wholly enclosed by the case aluminum, the electrodes 38 preferably protrude from the first end 26 of the billet 24 into the electrical chamber 14. The of the billet 24 physically separates the inlet 34 and outlet 36 of the process tube 18 from the electrodes 38 of the heating element 20.

The thermal well 22 preferably comprises three thermal wells 22*a*, 22*b*, 22*c*—corresponding to the number of heating elements 20*a*, 20*b*, 20*c*. The thermal well 22 draws heat from the process tube 18 and/or element 20 sufficient to determine the temperature of the fluid being heated. A portion of the thermal well 22 extends out of the second end 28 of the billet 24 sufficient to be coupled with a sensor 40 capable of measuring and determining the temperature as described.

The first end 26 of the billet 24 includes a protrusion 42 that is slightly narrower than the main body of the billet 24. The electrical chamber 14 is disposed in the first end 26 of the billet 24 such that at least a portion of the electrical chamber 14 passes through the protrusion 42. A portion of the electrical chamber 14 may also exist in the main body of the billet 24, e.g., not within the protrusion 42. As described above, the electrical chamber 14 encloses the electrodes 38 of the heating element 20. The electrical chamber 14 may also enclose the electrical connection between the electrodes 38 and electrical leads 44. The number of electrodes 38 and electrical leads 44 may be increased to correspond to the number of heating elements 20*a*, 20*b*, and 20*c*, as described above. The electrical chamber 14 may also enclose a proposer grounding wire 46 and grounding connection 48.

To physically isolate the electrical connections in the electrical chamber 14 from fumes or other potentially flammable materials, the electrical chamber 14 is preferably filled with a non-conductive epoxy or resin 50 to encapsulate the electrical connections. The epoxy or resin 50 surrounds the otherwise exposed electrical wires and connections, e.g., those not covered by wire insulation or similar materials, and prevents contact with the environment that may include flammable fumes or similar compounds. The first end 26 of the billet 24 is preferably covered by a housing cap 52 that includes a neck portion 54 configured for a tight fit connection over the protrusion 42. The protrusion 42 may include an O-ring groove 56 and an O-ring gasket 58 therein to form a hermetic seal between the protrusion 42 and the housing cap 52. This hermetic seal further isolates the electrical connection and prevents contact with the environment. An electrical conduit 60 passes through the housing cap in sealed manner so as to maintain the hermetic seal around the protrusion 42. The electrical leads 44 pass through the conduit 60 to reach the electrodes 38 as described above.

The housing 16 comprises a generally cylindrical hollow shell 62, which is integral or otherwise connectable with the housing cap 52. A layer of insulation 64 surrounds the billet 24 on all sides. A section of insulation 64*a* may be included within the housing cap 52 to provide complete insulative coverage. There is preferably an air gap 66 between the housing shell 62 and the insulation 64. This air gap 66 provides additional insulation protection against heat loss.

The housing 16, billet 14, and insulation 64 all preferably have a generally circular cross-section, i.e., cylindrical shape. Although other shaped cross-sections are possible, the circular cross-section maximizes heat efficiency while minimizing construction materials. As shown in FIGS. 3-6, the inlet 34, outlet 36, and a portion of each thermal well 22*a*, 22*b*, 22*c* protrude from the bottom of the housing shell 62 through a grommet or similar bore connectors 68, made from either metal or rubber. The grommet 68 is preferably sized to accommodate the inlet 34, outlet 36, or portion of thermal well 22 in such a way so as to seal against leaks or air gaps.

Although a particular embodiment has been described in detail for purposes of illustration, various modifications may be made without departing from the scope and spirit of the invention. Accordingly, the invention is not to be limited, except as by the appended claims.

What is claimed is:

1. A heater for solvents and flammable fluids, comprising:

a heater core having a process fluid tube, a heating element, and a thermal well, all enclosed within a billet, wherein the heating element is thermally associated with both the process fluid tube and the thermal well;

an electrical chamber embedded in a first end of the billet into which electrodes from the heating element extend and are connected to electrical wires from an electrical conduit, wherein the electrical chamber is filled with a non-conducting epoxy;

a housing cap disposed on the first end of the billet, wherein the electrical conduit passes through the housing cap; and an O-ring groove around the first end of the billet and an O-ring gasket disposed in the O-ring groove, wherein the O-ring gasket and O-ring groove form a hermetic seal between the housing cap and the first end of the billet.

2. The heater of claim 1, further comprising a fluid inlet and a fluid outlet on a second end of the billet, wherein the fluid inlet and the fluid outlet are fluidly connected to the process fluid tube.

3. The heater of claim 1, further comprising a thermal insulation layer surrounding the billet.

4. The heater of claim 3, further comprising a housing surrounding the billet and thermal insulation layer, wherein the housing forms a contiguous body with the housing cap.

5. The heater of claim 1, further comprising heat sensors operatively connected to the thermal well.

6. The heater of claim 1, wherein the process fluid tube comprises a coiled stack that surrounds the heating element substantially along its entire length.

7. The heater of claim 1, wherein the heating element comprises a U-shaped heating element.

8. The heater of claim 7, wherein the heating element comprises at least two U-shaped heating elements arranged in a nested configuration wherein two of the U-shaped heating elements are oriented orthogonally to one another.

9. The heater of claim 8, wherein the heating element comprises three U-shaped heating elements, wherein two of the U-shaped heating elements are oriented parallel to one another.

10. The heater of claim 1, comprising a plurality of heating elements and an equal number of thermal wells.

11. The heater of claim 1, wherein the billet comprises cast aluminum.

12. A heater for solvents and flammable fluids, comprising:

a heater core having a process fluid tube, a plurality of heating elements, and a plurality of thermal wells equal in number to the plurality of heating elements, all enclosed within a cast aluminum billet, wherein the heating elements are thermally associated with both the process fluid tube and the thermal wells;

an electrical chamber embedded in a first end of the cast aluminum billet into which electrodes from the heating element extend and are connected to electrical wires from an electrical conduit, wherein the electrical chamber is filled with a non-conducting epoxy;

a housing cap disposed on the first end of the cast aluminum billet, wherein the electrical conduit passes through the housing cap; and an O-ring groove around the first end of the cast aluminum billet and an O-ring gasket disposed in the O-ring groove, wherein the O-ring gasket and O-ring groove form a hermetic seal between the housing cap and the first end of the cast aluminum billet.

13. The heater of claim 12, further comprising heat sensors operatively connected to the thermal wells.

14. The heater of claim 12, further comprising a fluid inlet and a fluid outlet on a second end of the cast aluminum billet, wherein the fluid inlet and the fluid outlet are fluidly connected to the process fluid tube, which comprises a coiled stack that surrounds the heating elements substantially along their entire length.

15. The heater of claim 12, further comprising a thermal insulation layer surrounding the cast aluminum billet and a housing surrounding the cast aluminum billet and thermal insulation layer, wherein the housing forms a contiguous body with the housing cap.

16. The heater of claim 12, wherein the plurality of heating elements comprise at least three U-shaped heating elements arranged in a nested configuration wherein two of the at least three U-shaped heating elements are oriented orthogonally to one another and two of the at least three U-shaped heating elements are oriented parallel to one another.

17. A heater for solvents and flammable fluids, comprising:

a heater core having a process fluid tube, at least three U-shaped heating elements, and at least three thermal wells, all enclosed within a cast aluminum billet, wherein the at least three U-shaped heating elements are thermally associated with both the process fluid tube and the at least three thermal wells;

heat sensors operatively connected to the thermal wells;

an electrical chamber embedded in a first end of the cast aluminum billet into which electrodes from the heating element extend and are connected to electrical wires from an electrical conduit, wherein the electrical chamber is filled with a non-conducting epoxy;

a housing cap disposed on the first end of the cast aluminum billet, wherein the electrical conduit passes through the housing cap;

an O-ring groove around the first end of the cast aluminum billet and an O-ring gasket disposed in the O-ring groove, wherein the O-ring gasket and O-ring groove form a hermetic seal between the housing cap and the first end of the cast aluminum billet; and a thermal insulation layer surrounding the cast aluminum billet and a housing surrounding the cast aluminum billet and thermal insulation layer, wherein the housing forms a contiguous body with the housing cap.

18. The heater of claim 17, further comprising a fluid inlet and a fluid outlet on a second end of the cast aluminum billet, wherein the fluid inlet and the fluid outlet are fluidly connected to the process fluid tube, which comprises a coiled stack that surrounds the heating elements substantially along their entire length.

19. The heater of claim 17, wherein the least three U-shaped heating elements are arranged in a nested configuration wherein two of the at least three U-shaped heating elements are oriented orthogonally to one another and two of the at least three U-shaped heating elements are oriented parallel to one another.

20. A heater for solvents and flammable fluids, comprising:

a heater core having a process fluid tube, a heating element, and a thermal well, all enclosed within a billet, wherein the heating element is thermally associated with both the process fluid tube and the thermal well;

an electrical chamber embedded in a first end of the billet into which electrodes from the heating element extend and are connected to electrical wires from an electrical conduit, wherein the electrical chamber is filled with a non-conducting epoxy;

a housing cap disposed on the first end of the billet, wherein the electrical conduit passes through the housing cap;

a thermal insulation layer surrounding the billet; and a housing surrounding the billet and thermal insulation layer, wherein the housing forms a contiguous body with the housing cap.

21. The heater of claim 20, further comprising a fluid inlet and a fluid outlet on a second end of the billet, wherein the fluid inlet and the fluid outlet are fluidly connected to the process fluid tube.

22. The heater of claim 20, further comprising heat sensors operatively connected to the thermal well.

23. The heater of claim 20, wherein the process fluid tube comprises a coiled stack that surrounds the heating element substantially along its entire length.

24. The heater of claim 20, wherein the heating element comprises a U-shaped heating element.

25. The heater of claim 24, wherein the heating element comprises at least two U-shaped heating elements arranged in a nested configuration wherein two of the U-shaped heating elements are oriented orthogonally to one another.

26. The heater of claim 25, wherein the heating element comprises three U-shaped heating elements, wherein two of the U-shaped heating elements are oriented parallel to one another.

27. The heater of claim 20, comprising a plurality of heating elements and an equal number of thermal wells.

28. The heater of claim 20, wherein the billet comprises cast aluminum.

29. A heater for solvents and flammable fluids, comprising:

a heater core having a process fluid tube, at least two U-shaped heating elements arranged in a nested configuration wherein two of the U-shaped heating elements are oriented orthogonally to one another, and a thermal well, all enclosed within a billet, wherein the heating elements are thermally associated with both the process fluid tube and the thermal well;

an electrical chamber embedded in a first end of the billet into which electrodes from the heating elements extend and are connected to electrical wires from an electrical conduit, wherein the electrical chamber is filled with a non-conducting epoxy; and a housing cap disposed on the first end of the billet, wherein the electrical conduit passes through the housing cap.

30. The heater of claim 29, wherein the heating elements comprise three U-shaped heating elements, wherein two of the U-shaped heating elements are oriented parallel to one another.

31. The heater of claim 29, further comprising a fluid inlet and a fluid outlet on a second end of the billet, wherein the fluid inlet and the fluid outlet are fluidly connected to the process fluid tube.

32. The heater of claim 29, further comprising a thermal insulation layer surrounding the billet.

33. The heater of claim 29, further comprising heat sensors operatively connected to the thermal well.

34. The heater of claim 29, wherein the process fluid tube comprises a coiled stack that surrounds the heating elements substantially along their entire length.

* * * * *